US008334661B2

(12) United States Patent
Lee et al.

(10) Patent No.: US 8,334,661 B2
(45) Date of Patent: Dec. 18, 2012

(54) FEEDBACK CONTROL CIRCUIT AND POWER CONVERTING CIRCUIT

(75) Inventors: Li-Min Lee, Taipei County (TW); Chung-Che Yu, Taipei County (TW); Shian-Sung Shiu, Taipei County (TW); Xi Tu, Wuxi (CN)

(73) Assignee: Green Solution Technology Co., Ltd., New Taipei (TW)

( * ) Notice: Subject to any disclaimer, the term of this patent is extended or adjusted under 35 U.S.C. 154(b) by 172 days.

(21) Appl. No.: 12/886,504

(22) Filed: Sep. 20, 2010

(65) Prior Publication Data

US 2011/0279061 A1 Nov. 17, 2011

(30) Foreign Application Priority Data

May 11, 2010 (CN) ..... 2010 1 0170215

(51) Int. Cl.
*G05F 1/00* (2006.01)

(52) U.S. Cl. ..... 315/291; 315/307

(58) Field of Classification Search ..... 315/291, 315/307, 308, 312, 246, 209 R
See application file for complete search history.

(56) References Cited

U.S. PATENT DOCUMENTS 7,615,937 B2 * 11/2009 Mishima ..... 315/291
7,999,484 B2 * 8/2011 Jurngwirth et al. ..... 315/247
7,999,487 B2 * 8/2011 Szczeszynski ..... 315/291

* cited by examiner

*Primary Examiner* — Minh D A
(74) *Attorney, Agent, or Firm* — Jianq Chyun IP Office

(57) ABSTRACT

An exemplary embodiment of the invention provides a set of an initial value of an error amplifying signal in the feedback control circuit for feedback control, so as to reduce the time and the amplitude of oscillation of the error amplifying signal. Accordingly, a feedback control circuit and a power converting circuit provided in an exemplary embodiment of the invention not only reduce the degree and the time of overshoot but also provide accurate and stable feedback control.

12 Claims, 4 Drawing Sheets

FEEDBACK CONTROL CIRCUIT AND POWER CONVERTING CIRCUIT

CROSS-REFERENCE TO RELATED APPLICATION

This application claims the priority benefit of China application serial no. 201010170215.X, filed on May 11, 2010. The entirety of the above-mentioned patent application is hereby incorporated by reference herein and made a part of this specification.

BACKGROUND OF THE INVENTION

1. Field of the Invention

The invention relates to a feedback control circuit and a power converting circuit, and particularly to a feedback control circuit and a power converting circuit capable of reducing overshoot.

2. Description of Related Art

FIG. 1 is a schematic view of a conventional light emitting diode (LED) driving circuit. Referring to FIG. 1, the LED driving circuit includes a controller 10, a converting circuit 50, and an LED module 60. The converting circuit 50 is coupled to an input voltage source Vin. The controller 10 generates a control signal Sc to control the converting circuit 50 to transmit an electric power from the input voltage source Vin to an output end. The output end of the converting circuit 50 is coupled to the LED module 60 to apply an output voltage Vout to the LED module 60, such that the LED module 60 emits light due to an output current Iout flowing through the LED module 60. The output current Iout also flows through a current detecting resistor 65 to generate a current feedback signal IFB.

The controller 10 includes an error amplifier 11, a ramp generator 12, an error compensating circuit 13, a pulse width modulation (PWM) comparator 18, and a driving circuit 19. The error amplifier 11 receives the current feedback signal IFB and a reference signal Vr and accordingly generates an output signal. After the error compensating circuit 13 compensates the output signal, the output signal becomes an error amplifying signal Vcomp. The ramp generator 12 generates a ramp signal to the PWM comparator 18. The PWM comparator 18 also receives error amplifying signal Vcomp and accordingly generates a PWM signal to the driving circuit 19.

Generally, the controller 10 stabilizes the output current Iout at a predetermined output current Io, and at this time, the output voltage Vout is also stabilized at a predetermined output voltage Vo. However, before output current Iout and output voltage Vout being stabled, the level of the error amplifying signal Vcomp is adjusted by the error amplifier 11 comparing the current feedback signal IFB and the reference signal Vr, and the error compensating circuit 13, compensating the output of the error amplifier 11. During the feedback control process, the output current Iout and the output voltage Vout respectively oscillate about the predetermined output current Io and the predetermined output voltage Vo and gradually approximate thereto, i.e. the amplitudes of oscillation become small.

FIG. 2 illustrates signal waveforms of the LED driving circuit shown in FIG. 1 during dimming process. The driving circuit 19 receives a dimming signal DIM and determines whether to output the control signal Sc according to the dimming signal DIM. During the period from the time point T1 to the time point T4, the dimming signal DIM represents "ON", and at this time, the driving circuit 19 outputs the control signal Sc; and during the period from the time point T4 to the time point T1, the dimming signal DIM represents "OFF", and at this time, the driving circuit 19 stops outputting the control signal Sc. During the period from the time point T4 to the time point T1, because the driving circuit 19 stops outputting the control signal Sc, the converting circuit 50 stops transmitting the electric power to the LED module 60. As a result, the output voltage Vout gradually falls down to the threshold voltage Vf of the LED module 60 at the time point T5, and at this time, the output current Iout also falls down to zero. It causes the current feedback signal IFB and the reference signal Vr to maintain a positive error, such that the level of the error amplifying signal Vcomp is raised up to a maximum level. At time point T1, when the driving circuit 19 outputs the control signal Sc again, because the level of the error amplifying signal Vcomp is at the maximum level, the duty cycle of the control signal Sc is also maximum.

After the time point T2, the output current Iout is higher than the predetermined output current Io, such that the error amplifier 11 starts to pull down the level of the error amplifying signal Vcomp. However, due to the error compensation of the error compensating circuit 13, the error amplifying signal Vcomp can not directly fall down to an error stable value Vcompo. This value corresponds to the level of the error amplifying signal Vcomp when the output current Iout is stabilized at the predetermined output current Io. It causes the duty cycle of the control signal Sc is over large at this time. Accordingly, the output current Iout is still raised up until the error amplifying signal Vcomp is lower than the error stable value Vcompo, such that the duty cycle of the control signal Sc is over small. Next, the output current Iout is lower than the predetermined output current Io again, such that the error amplifying signal Vcomp is raised up and higher than the error stable value Vcompo again. The foregoing process proceeds until the time point T3, and the output current Iout, the output voltage Vout, and the error amplifying signal Vcomp respectively converge on the predetermined output current Io, the predetermined output voltage Vo, and the error stable value Vcompo.

Accordingly, when the LED module starts or burst dimming is performed, an obvious and serious overshoot phenomenon occurs in the output current Iout and the output voltage Vout. An over large overshoot phenomenons occurring in current and voltage cause the LEDs immediately emit light with over high brightness, so as to affect human eyes. Besides the stability of the circuit is lowered, the lifespan of the LEDs is also reduced, and the probability of the circuit or the LEDs being burnt down is increased.

SUMMARY OF THE INVENTION

In the foregoing related art, the serious overshoot phenomenon due to the error compensation of feedback control reduces the stability of the circuit and increases the probability of the circuit being burnt down. Accordingly, an exemplary embodiment of the invention provides a set of an initial value of an error amplifying signal in the feedback control circuit for feedback control, so as to reduce the time and the amplitude of oscillation of the error amplifying signal. Accordingly, a feedback control circuit and a power converting circuit provided in an exemplary embodiment of the invention not only reduce the degree and the time of overshoot but also provide accurate and stable feedback control.

An exemplary embodiment of the invention provides a feedback control circuit adapted to control a converting circuit to convert an input voltage into an output voltage to drive a load. The feedback control circuit includes a feedback unit, an integrating unit, a pulse width control unit, a first switch, and a level setting unit. The feedback unit receives a feedback signal and a reference signal and accordingly generating an error signal, wherein the feedback signal represents a state of the load. The integrating unit is coupled to the feedback unit to generate an integration signal according to the error signal. The pulse width control unit generates a control signal according to the integration signal and accordingly controls the converting circuit to convert the input voltage into the output voltage. The first switch is coupled between the feedback unit and the integrating unit and controls the error signal to be transmitted to the integrating unit. The level setting unit is coupled to the integrating unit, determines a set level according to the integration signal when the first switch is conducted, and adjusts a level of the integration signal to the set level when the first switch is cut off.

Another exemplary embodiment of the invention provides a power converting circuit adapted to drive a light emitting diode module. The power converting circuit includes a converting circuit and a controller. The converting unit is coupled to the LED module and converts an electric power of a power source to drive the LED module. The controller performs a feedback control to generate a pulse width modulation signal (PWM signal) according to a feedback signal representing the amount of a current flowing through the LED module, so as to control the power converting circuit to stabilize the current at a predetermined current value. Herein, the controller receives a dimming signal, stops the converting circuit converting the electric power of the power source when the dimming signal is in a first state, and starts to perform the feedback control to modulate a duty cycle of the PWM signal starting from a predetermined duty cycle when the dimming signal is in a second state.

It is to be understood that both the foregoing general descriptions and the following detailed descriptions are exemplary, and are intended to provide further explanation of the invention as claimed. In order to make the features and the advantages of the invention comprehensible, exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
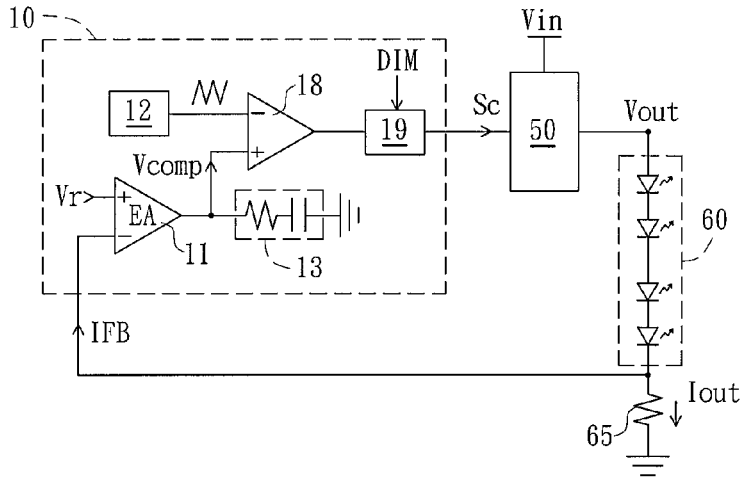
FIG. 1 (RELATED ART)
FIG. 1 is a schematic view of a conventional LED driving circuit.
Figure 2:
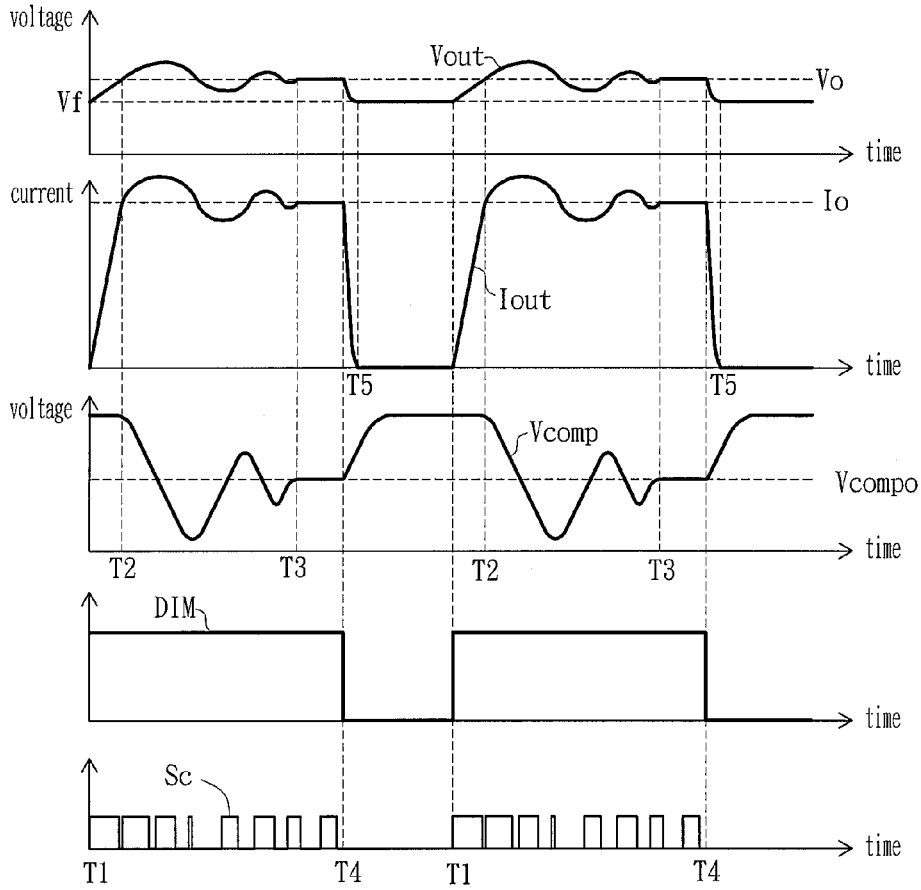
FIG. 2 (RELATED ART)
FIG. 2 illustrates signal waveforms of the LED driving circuit shown in FIG. 1 during dimming process.
Figure 3:
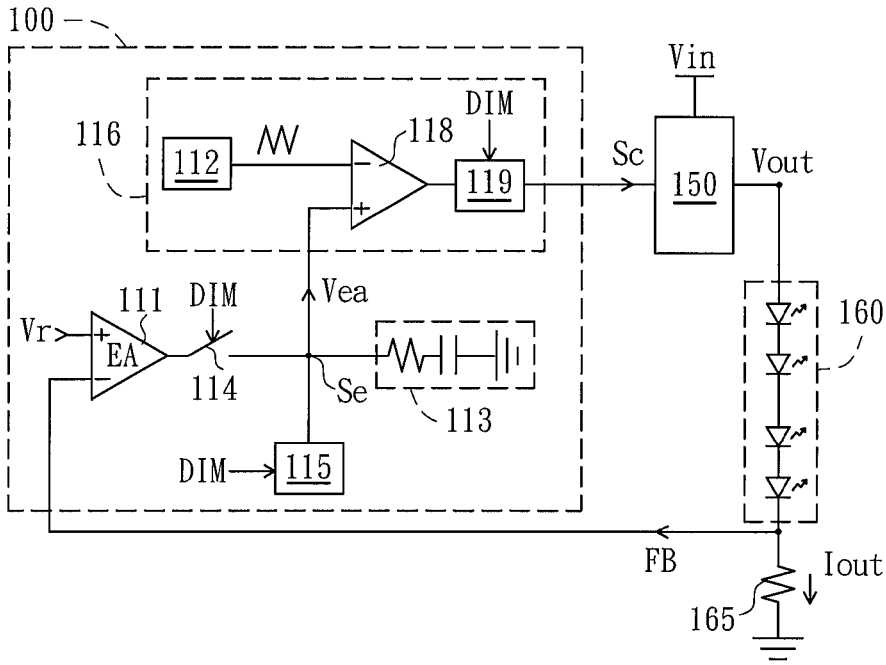
FIG. 3 is a schematic view of a power converting circuit according to a first embodiment of the invention.

FIG. 3 is a schematic view of a power converting circuit according to a first embodiment of the invention. Referring to FIG. 3, the power converting circuit includes a controller 100 and a converting circuit 150 to drive an LED module 160. The controller 100 receives a feedback signal FB and performs feedback control to generate a control signal Sc to control the converting circuit 150. The input end of the converting circuit 150 is coupled to an input voltage source Vin, and the output end thereof is coupled to the LED module 160. The converting circuit 150 adjusts the value of the electric power from the input voltage source Vin according to the control signal Sc and converts it into a suitable output voltage Vout to drive the LED module, such that an output current Iout flowing through the LED module is stabilized at a predetermined current value. The output current Iout also flows through a current detecting resistor 165 to generate the current feedback signal FB representing the amount of the output current Iout.

The controller 100 includes a feedback unit 111, an integrating unit 113, a first switch 114, a level setting unit 115, and a pulse width control unit 116. The feedback unit 111 may be an error amplifier. The non-inverting input end receives a reference signal Vr, and the inverting input end receives the feedback signal FB. The feedback unit 111 accordingly generates an error signal. The integrating unit 113 generates an integration signal Vea according to the error signal and generally includes a capacitor and a resistor. In practice, the relationship of the voltage gain of the integrating unit 113 versus the frequency is adjusted to have a better transient response in difference circuit design. The first switch 114 is coupled between the feedback unit 111 and the integrating unit 113 and controls the error signal to be transmitted to the integrating unit 113 according to a dimming signal DIM. When the state of the dimming signal DIM represents "ON", the first switch 114 is conducted. The error signal generated by the feedback unit 111 is transmitted to the integrating unit 113 through the first switch 114. When the state of the dimming signal DIM represents "OFF", the first switch 114 is cut off. The error signal generated by the feedback unit 111 stops being transmitted to the integrating unit 113. The level setting unit 115 is coupled to the integrating unit 113. When the first switch 114 is conducted, the level setting unit 115 determines a set level Vset according to the integration signal Vea, and when the first switch 114 is cut off, the level setting unit 115 adjusts the level of the integration signal 114 to the set level Vset.

The pulse width control unit 116 generates a control signal Sc according to the integration signal Vea and accordingly controls the converting circuit 150 to perform the voltage conversion. The pulse width control unit 116 includes a ramp generator 112, a PWM comparator 118, and a driving circuit 119. The ramp generator 112 generates a ramp signal to the inverting input end of the PWM comparator 118, and the non-inverting input end of the PWM comparator 118 receives the integration signal Vea. The PWM comparator 118 accordingly generates a PWM signal to the driving circuit 119. The driving circuit 119 also receives the dimming signal DIM. When the state of the dimming signal DIM represents "ON", the driving circuit 119 generates the control signal Sc according to the PWM signal of the PWM comparator 118; and when the state of the dimming signal DIM represents "OFF", the driving circuit 119 stops generating the control signal Sc.

Figure 4:
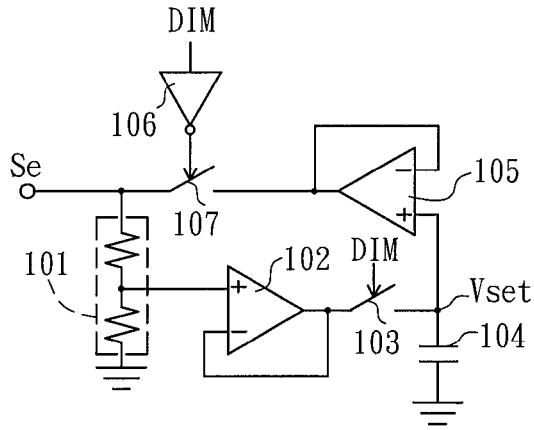
FIG. 4 is a schematic circuit of a level setting unit according to an embodiment of the invention.

FIG. 4 is a schematic circuit of a level setting unit according to an embodiment of the invention. Referring to FIG. 4, the level setting unit includes a voltage divider 101, a first amplifier 102, a third switch 103, a voltage storage element 104, a second amplifier 105, an inverter 106, and a second switch 107. Referring to FIG. 3 and FIG. 4, when the state of the dimming signal DIM represents "ON", the first switch 114 is conducted, such that the integration signal Vea is inputted through a connecting point Se to the non-inverting input end of the first amplifier 102 after being divided by the voltage divider 101. The inverting input end of the first amplifier 102 is coupled to the output end thereof, and the output end thereof is also coupled to the voltage storage element 104. The voltage storage element 104 may be a capacitor coupled to the first amplifier 102 through the third switch 103. The third switch 103 is controlled by the dimming signal DIM and conducted when the state of the dimming signal DIM represents "ON", such that the voltage storage element 104 and the first amplifier 102 form a voltage follower to store the level of the integration signal Vea which has been divided by the voltage divider 101 in the voltage storage element 104 to form the set level Vset. At the same time, the dimming signal DIM which has been inverted by the inverter 106 controls the second switch 107 such that the second switch 107 is cut off.

When the state of the dimming signal DIM represents "OFF", the first switch 114 and the third switch 103 are cut off, the voltage storage element 104 has stored the set level Vset by referring to the integration signal Vea and before. The dimming signal DIM which has been inverted by the inverter 106 controls the second switch 107 to be conducted. At this time, the output end of the second amplifier 105 is coupled to the connecting point Se, i.e. coupled to the integrating unit 113, the output end of the second amplifier 105 is also coupled to the inverting input end thereof, and the non-inverting input end thereof is coupled to the voltage storage element 104 to receive the set level Vset. Accordingly, the second amplifier 105 adjusts the level of the integration signal Vea to be the same as the set level Vset.

In the present embodiment, the voltage storage element 104 sets the set level Vset according to the level of the integration signal Vea which has been divided by the voltage divider 101. Accordingly, the set level Vset is lower than the level of the integration signal Vea. In practice, the ratio of the set level Vset and the level of the integration signal Vea can approximate to the value 1, e.g. 1.2 or 0.8, and it will not affect the advantage of the invention.

Figure 5:
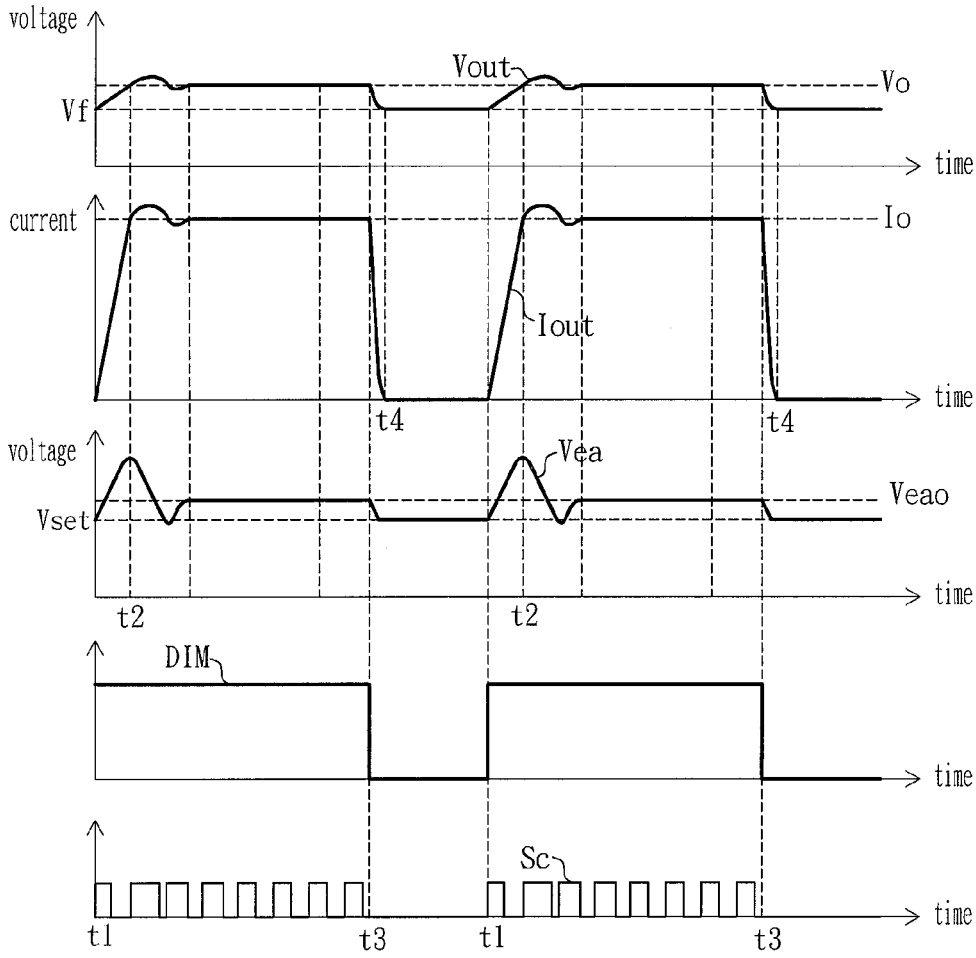
FIG. 5 illustrates signal waveforms of the circuits shown in FIG. 3 and FIG. 4 during dimming process.

FIG. 5 illustrates signal waveforms of the circuits shown in FIG. 3 and FIG. 4 during dimming process. In this embodiment, the set level Vset is lower than the level of the integration signal Vea, for example. At the time point t1, the dimming signal DIM just changes from the low level representing "OFF" to the high level representing "ON". At this time, the output voltage Vout is rising from the threshold voltage Vf, the output current Iout is rising from zero, and the integration signal Vea is rising from the set level Vset. Accordingly, the duty cycle of the control signal Sc starts to perform feedback control from a predetermined duty cycle (corresponding to the set level Vset). At the time point t2, the output current Iout rises to the predetermined output current Io, and the integration signal Vea rises to a peak value at this time. Because the integration signal Vea is raised up from the set level Vset instead of the maximum of the integration signal Vea, like in the foregoing related art, the peak value is, ib general, lower than the maximum of the integration signal Vea, ie, the driving voltage applied to the error amplifier 111. Accordingly, the output voltage Vout, the output current Iout, and the integration signal Vea can become stable faster compared with those in the foregoing related art. At the time point t3, the dimming signal DIM just changes from the high level representing "ON" to the low level representing "OFF". The level of the integration signal Vea is then adjusted to be the same as the set level Vset, and the control signal Sc stops being generated such that the converting circuit stops transmitting the electric power. At this time, the output voltage Vout and the output current Iout start to fall down. At the time point t4, the output voltage Vout falls down to the threshold voltage Vf, and the output current Iout also falls down to zero at this time.

Figure 6:
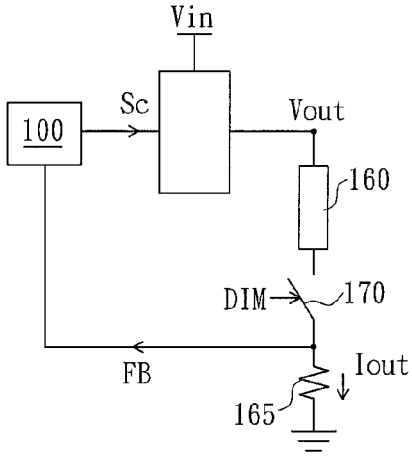
FIG. 6 is a schematic view of a power converting circuit according to a second embodiment of the invention.
Figure 7:
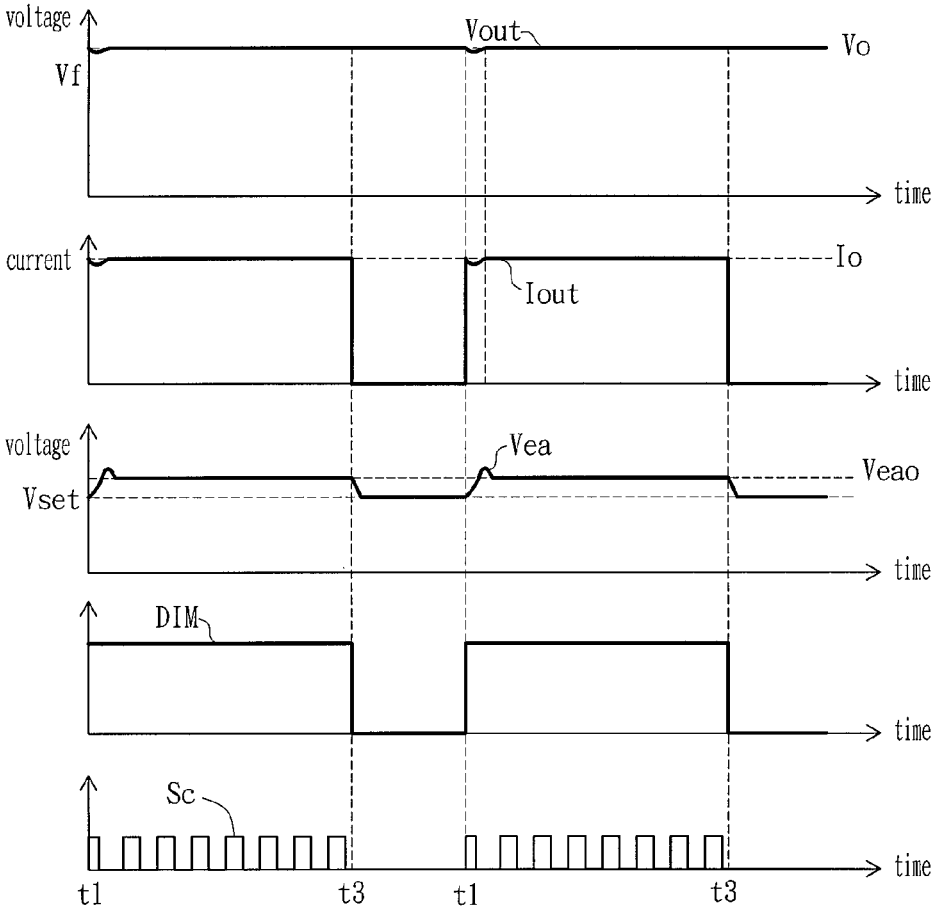
FIG. 7 illustrates signal waveforms of the power converting circuit shown in FIG. 7 during dimming process.

FIG. 6 is a schematic view of a power converting circuit according to a second embodiment of the invention. Referring to FIG. 6, compared with that of the embodiment of FIG. 3, the power converting circuit further includes a driving switch 170 coupled to the LED module 160 in the present embodiment. FIG. 7 illustrates signal waveforms of the power converting circuit shown in FIG. 7 during dimming process. Referring to FIG. 6 and FIG. 7, when the state of the dimming signal DIM represents "ON", the driving switch 170 is conducted, the operation of the power converting circuit is the same as that of the circuit shown in FIG. 3. When the state of the dimming signal DIM represents "OFF", the driving switch 170 is cut off, such that the output current Iout can not flow to the ground through the current detecting resistor 165. That is, the path of which the converting circuit 150 provides the electric power to the LED module 160 is cut off. Accordingly, the level of the output voltage Vout can still maintain at that of the predetermined output voltage Vo. When the dimming signal DIM changes to the level representing "ON" in the next period, the level of the output voltage Vout becomes stable faster.

As the above description, the invention completely complies with the patentability requirements: novelty, non-obviousness, and utility. It will be apparent to those skilled in the art that various modifications and variations can be made to the structure of the invention without departing from the scope or spirit of the invention. In view of the foregoing descriptions, it is intended that the invention covers modifications and variations of this invention if they fall within the scope of the following claims and their equivalents.

What is claimed is:

1. A feedback control circuit, adapted to control a converting circuit to convert an input voltage into an output voltage to drive a load, the feedback control circuit comprising:

a feedback unit receiving a feedback signal and a reference signal and accordingly generating an error signal, wherein the feedback signal represents a state of the load;

an integrating unit coupled to the feedback unit to generate an integration signal according to the error signal;

a pulse width control unit generating a control signal according to the integration signal and accordingly controlling the converting circuit to convert the input voltage into the output voltage;

a first switch coupled between the feedback unit and the integrating unit and controlling the error signal to be transmitted to the integrating unit; and a level setting unit coupled to the integrating unit, determining a set level according to the integration signal when the first switch is conducted, and adjusting a level of the integration signal to the set level when the first switch is cut off.

2. The feedback control circuit as claimed in claim 1, wherein the load is a light emitting circuit, and the first switch is switched according to a dimming signal.

3. The feedback control circuit as claimed in claim 1, wherein the set level is lower than the level of the integration signal when the first switch is conducted.

4. The feedback control circuit as claimed in claim 1, wherein the level setting unit comprises a level storage element and a second switch, the level storage element stores the set level, the second switch is cut off when the first switch is conducted, and the second switch is conducted when the first switch is cut off.

5. A power converting circuit, adapted to drive a light emitting diode module (LED module), the power converting circuit comprising:

a converting circuit coupled to the LED module and converting an electric power of a power source to drive the LED module; and a controller performing a feedback control to generate a pulse width modulation signal (PWM signal) according to a feedback signal representing an amount of a current flowing through the LED module, so as to control the converting circuit to stabilize the current at a predetermined current value, wherein the controller receives a dimming signal, stops the converting circuit converting the electric power of the power source when the dimming signal is in a first state, and starts to perform the feedback control to modulate a duty cycle of the PWM signal starting from a predetermined duty cycle when the dimming signal is in a second state, wherein the controller comprises a first switch coupled between an error amplifier and an integrating unit and controlling an error signal to be transmitted to the integrating unit.

6. The power converting circuit as claimed in claim 5, wherein the controller further comprises:

the error amplifier generating the error signal according to the feedback signal and a reference signal;

the integrating unit coupled to the error amplifier to generate an integration signal according to the error signal; and a level setting circuit coupled to the integrating unit, determining a set level according to the integration signal when the first switch is conducted, and adjusting a level of the integration signal to the set level when the first switch is cut off.

7. The power converting circuit as claimed in claim 6, wherein the set level is lower than the level of the integration signal when the dimming signal is in the second state.

8. The power converting circuit as claimed in claim 6, wherein the level setting unit comprises a level storage element and a second switch, the level storage element stores the set level, the second switch is conducted when the dimming signal is in the first state, and the second switch is cut off when the dimming signal is in the second state.

9. The power converting circuit as claimed in claim 5, further comprising a driving switch, wherein the driving switch is coupled to the LED module and stops the converting circuit providing the electric power to the LED module when the dimming signal is in the first state.

10. The power converting circuit as claimed in claim 9, wherein the controller comprises:

an error amplifier generating an error signal according to the feedback signal and a reference signal;

an integrating unit coupled to the error amplifier to generate an integration signal according to the error signal;

a switch coupled between the error amplifier and the integrating unit and controlling the error signal to be transmitted to the integrating unit; and a level setting circuit coupled to the integrating unit, determining a set level according to the integration signal when the switch is conducted, and adjusting a level of the integration signal to the set level when the switch is cut off.

11. The power converting circuit as claimed in claim 9, wherein the set level is lower than the level of the integration signal when the dimming signal is in the second state.

12. The power converting circuit as claimed in claim 9, wherein the level setting unit comprises a level storage element and a switch, the level storage element stores the set level, the switch is conducted when the dimming signal is in the first state, and the switch is cut off when the dimming signal is in the second state.

* * * * *